United States Patent [19]

Stuart

[11] Patent Number: 4,473,333

[45] Date of Patent: Sep. 25, 1984

[54] REFUSE HANDLING DEVICE FOR USE IN A REFUSE TRANSPORT VEHICLE

[76] Inventor: Donald D. Stuart, 1816 23rd Ave., NW., Calgary, Alberta, T2M 1V7, Canada

[21] Appl. No.: 317,855

[22] Filed: Nov. 3, 1981

[51] Int. Cl.[3] ..... B65F 3/04

[52] U.S. Cl. ..... 414/493; 414/501; 100/233

[58] Field of Search ..... 414/491, 492, 498, 501, 414/525 R; 100/233, 250

[56] References Cited

U.S. PATENT DOCUMENTS

| | | | |
|---|---|---|---|
| 2,561,608 | 7/1951 | Boissonnault | 414/501 |
| 2,748,964 | 5/1956 | Murphy | 414/472 |
| 2,798,624 | 7/1957 | Brown et al. | 414/525 R |
| 2,849,134 | 8/1958 | Linde | 414/409 |
| 2,961,105 | 11/1960 | Shubin | 414/525 R |
| 3,049,256 | 8/1962 | Urban | 414/501 |
| 3,063,586 | 11/1962 | Appleman | 414/406 |
| 3,130,845 | 4/1964 | French et al. | 414/406 |
| 3,202,304 | 8/1965 | Lannen | 414/498 |
| 3,230,868 | 1/1966 | Smith | 414/525 X |
| 3,300,071 | 1/1967 | Isaacs | 414/458 |
| 3,325,024 | 6/1967 | Shubin | 414/406 |
| 3,355,043 | 11/1967 | Talbert | 414/498 X |
| 3,487,967 | 1/1970 | Brisson | 414/499 |
| 3,658,199 | 4/1972 | Owen, Jr. | 414/406 X |
| 3,881,613 | 5/1975 | Torimoto et al. | 414/498 X |
| 3,921,839 | 11/1975 | Herpich | 414/406 X |
| 3,999,669 | 12/1976 | Smith | 100/233 X |
| 4,096,959 | 6/1978 | Schaffler | 414/525 X |

FOREIGN PATENT DOCUMENTS

| | | | |
|---|---|---|---|
| 418773 | 2/1944 | Canada . | |
| 773413 | 12/1967 | Canada . | |
| 860747 | 1/1971 | Canada . | |
| 863132 | 2/1971 | Canada . | |
| 1272216 | 7/1968 | Fed. Rep. of Germany | 414/492 |
| 0087420 | 8/1978 | Japan | 414/492 |
| 792098 | 3/1958 | United Kingdom . | |

*Primary Examiner*—Robert J. Spar
*Assistant Examiner*—Ken Muncy
*Attorney, Agent, or Firm*—Cushman, Darby & Cushman

[57] ABSTRACT

The bulkhead of a solid refuse transport vehicle of the type having a tilting bucket and a tilting packer plate the free end edge of which discharges the contents of the bucket is improved by providing the packer plate with a convex protrusion extending transversely of the packer plate and disposed near the discharge opening, to improve the pre-compacting of the refuse before its discharge from the bulkhead. The improved arrangement can be combined with a further feature of the invention whereby a standard, rectangular refuse container is releasably held in abutment with the bulkhead.

10 Claims, 12 Drawing Figures

REFUSE HANDLING DEVICE FOR USE IN A REFUSE TRANSPORT VEHICLE

The present invention relates to refuse handling and in particular to a refuse loading device for use in a refuse transport vehicle.

Many different types of refuse loading mechanism have been known for many years.

Basically, the refuse loading mechanism forms a part of so-called bulkhead forming a chamber into which refuse can be conveniently loaded, usually from both sides or from the rear. The chamber comprises a mechanism for transfer of the thus loaded refuse into a refuse bin forming a storage part of the body of the vehicle.

The refuse transfer mechanism operatively associated with a bulkhead has to meet the prerequisite of being capable of operating under heavy loads and stresses due to vast differences in the nature of different refuse to be transported by the vehicle. Accordingly, it is desirable that the load transfer mechanism be reliable in operation. As is well known, the reliability in operation is often directly dependent on relative structural simplicity, particularly if the device has to operate in a highly contaminated environment typical for refuse transportation.

From the standpoint of structural simplicity, the mechanism known, for instance, from U.S. Pat. No. 2,798,624, issued July 9, 1957 to A. G. Brown et al. and entitled "Refuse Body Loading Mechanism" presents an optimum solution. Briefly, the bulkhead of the device contains a bucket which can be raised from a lowered to an elevated position by pivoting the bucket about a single transverse axis. A packer plate, also pivotable about a transverse axis disposed somewhat above the axis of the bucket cooperates with the bucket to sweep the refuse from the raised bucket into the storage bin. The storage bin or chamber of the vehicle is usually a large compartment. As the compartment becomes filled, the packer plate also assists in a certain degree of compacting of the refuse within the storage compartment by forcing further batches of refuse into the chamber.

It has been recognized by others that due to the relatively large volume of the storage compartment of a refuse transporting vehicle, the practically obtainable degree of compactness of the refuse within the large storage container is insufficient. Proposals have been made to increase the compactness of refuse within the storage body or container of the vehicle by arranging therein a transverse partition associated with a hydraulic mechanism which, in effect, initially reduces the filled volume of the storage container so that the compacting within the storage container takes place even if the volume of refuse within the container is only a fraction of the overall volume of the container. U.S. Pat. No. 3,049,256 issued Aug. 14, 1962 to G. E. Urban and entitle "Refuse Body Loading & Packing Mechanisms" is typical of such solution. The Urban proposal, while presenting advance over the Brown et al. arrangement, still requires an additional hydraulic mechanism for adjusting and maintaining the position of the partition within the storage container. Both Urban and Brown vehicles operate with a very bulky storage container which, in turn, requires a heavy vehicle, often too heavy, long and noisy for relatively narrow neighborhood streets.

Attempts have been made to eliminate bulky and heavy refuse collecting vehicles by introducing a new concept whereby the storage container of the prior art bodies was replaced by refuse bins removably attached to a vehicle frame and loaded during the collecting round of the vehicle by a hydraulic ram device forcing the refuse from a loading section of the body into the detachable bin. The filled bin is then deposited at a predetermined depot and a bulk of the containers is then transported by a heavy vehicle to a dump site. An example of a vehicle of this kind is presented in U.S. Pat. No. 3,487,967 issued Jan. 6, 1970 to J. R. Brisson. The shown device has a loading portion generally centrally of the chasis of the vehicle and a heavy duty mechanism pushes the refuse from the loading area into the container attached at the rear of the vehicle. It is believed that the solution as shown in the Brisson patent is of disadvantage since it still requires a relatively long and specially designed vehicle frame. Thus, compared with the first two prior art references, Brisson, while reducing the size of the storage chamber or compartment still requires a long chassis designed especially for the purpose.

It is an object of the present invention to provide an improved bulkhead mechanism of the type shown in the aforesaid U.S. patents to Brown et al. Another object of the present invention is to provide a vehicle for use in refuse collection of the type described in the Brisson patent, wherein the overall structure of the refuse loading, transfer and storage sections is simplified and can be mounted on a relatively light truck without requiring a special type of the frame of the vehicle.

In general terms, the present invention can be defined, in one aspect thereof, as a refuse loading device for use in a vehicle, said device including, in combination: a bulkhead chamber having a refuse loading opening and a refuse discharge opening; bucket means within said chamber, said bucket means being including a bucket disposed for pivotal movement about a transverse, normally generally horizontal first axis, from a lowered position, wherein the bucket is accessible for loading refuse into same through the loading opening, to a raised position in which the bucket is ready for discharge of its contents through said discharge opening; a packer plate within said chamber disposed for pivotal movement about a second axis generally parallel with said first axis and normally disposed generally vertically above same; said bucket and said packer plate being so arranged, disposed and shaped that, with the bucket raised, the packer plate can swing about said second axis to sweep refuse from the bucket through said discharge opening; said discharge opening being a generally rectangular passage in one end of said bulkhead chamber, the passage being limited by a generally horizontal top, a generally horizontal bottom and two opened, normally vertical sides; said second axis being closely spaced from and being generally parallel with said top of the passage and with one end of said packer plate, whereby said packer plate can swing from a first position wherein the plate protrudes inwardly into the chamber, to a second position wherein the plate is generally flush with and closes said passage; a protrusion member disposed at a close inward spacing of said discharge opening when the packer plate is in said first position, the protrusion member extending along said top of the passage but protrudes below a normally horizontal level coincident with said top, to thus produce an obstruction limiting the clearance of the passage at the interior of the chamber.

In another aspect, the present invention provides a refuse loading device for use with a vehicle for transporting refuse, said device comprising, in combination: a bulkhead chamber having a refuse loading opening and a refuse discharge opening spaced from the former; refuse transfer means within said chamber for transferring refuse from a region proximate to the loading opening to and through said discharge opening; mounting means for securing said chamber to a vehicle frame; chamber positioning means adapted to selectively change the position of the chamber relative to the respective vehicle frame from a first position wherein said discharge opening is disposed above the respective vehicle frame and is coincident with a generally vertical plane transverse of the respective vehicle frame, to a second position wherein said discharge opening is disposed beyond the respective vehicle frame and is coincident with a generally horizontal plane spaced above the ground at a predetermined vertical spacing, said vertical spacing being slightly in excess of the height of a standard refuse collecting container, and means for detachably securing to said chamber a refuse storage bin.

The advantage of the first mentioned general arrangement is in that, while retaining the simplicity of the general arrangement as described, for instance, in the Brown et al. patent, the protrusion member as set forth assists in precompacting the refuse prior to its discharge from the chamber. Accordingly, the refuse leaving the bulkhead on sweeping motion of the packer plate is already partly precompacted, a condition particularly but not exclusively suitable for the type of refuse handling utilizing a relatively small volume storage compartment or bin.

The second general feature of the invention presents a substantial structural simplification of the overall vehicle for use in the method as generally shown in the Brisson patent. The device is capable of application on a relatively light truck chassis without requiring a special design of the frame of the vehicle thus significantly reducing the cost of the entire unit.

The invention will now be described by way of a preferred embodiment with reference to the accompanying simplified drawings wherein.

Figure 1:
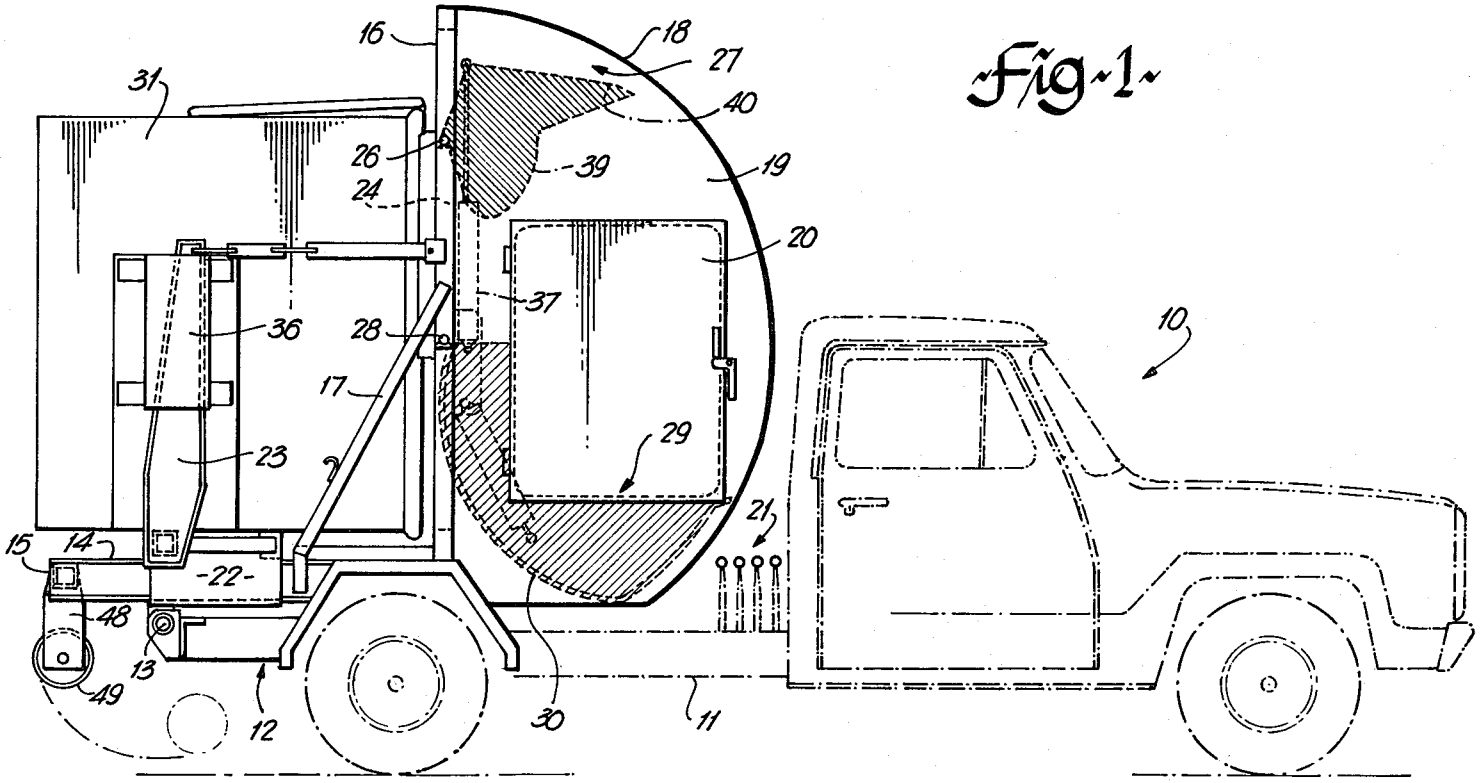
FIG. 1 is a simplified side view of a light truck equipped with the refuse loading device of the present invention with certain parts of the device omitted for the sake of clarity.

Turning firstly to FIG. 1, reference numeral 10 designates a truck having a chassis 11 shown only in a schematic way. At the rear end 12 of the chassis 11 are arranged journals such as journal 13 for pivotal securement to the chassis 11 of a frame including a pair of tipping rails or sills of which only rail 14 is visible in FIG. 1. The free end 15 of the rail 14 protrudes rearwards a distance suitable for bringing the free end 15 slightly above the ground when the frame is pivoted as later described. The front end of the rails 14 is fixedly secured to and thus integral with an upright, generally rectangular frame member 16, the securement of the frame member 16 to the respective rail 14 being reinforced by strut members 17, one at each side. The upright frame member 16 is fixedly secured to the periphery of one end of a bulkhead chamber 18 including two generally upright side walls such as the side wall 19, provided with a loading door 20. Accordingly, the bulkhead chamber is also integral with the rails 14.

The pivotal mounting at journals 13 as shown in FIG. 1, together with a suitable hydraulic device (referred to later) makes it possible to pivot the rails 14, the upright frame member 16, the strut member 17, and the entire chamber 18 about a transverse, normally horizontal axis of the journals 13 on actuation of one of the control elements 21. The rails 14 and thus the chamber 18 therefore can be pivoted from a first position (FIG. 1), wherein the upright frame member 16 (and thus the rear end of the chamber 18) is upright, to a second position (FIG. 12) wherein the frame member 16 is generally horizontal.

The pair of rails 14 form a guide for a rugged slide frame 22, to which is secured a pair of fork elements 23. The slide 22 and the forklift elements 23 thus form a forklift mechanism, it being understood that one of the control elements 21 controls a hydraulic cylinder (later referred to in greater detail) adapted for selectively displacing the slide 22 along the rails 14.

In summary, therefore, two basic movements are made possible by the thus far described mechanism: (1) the chamber 18 can be tipped over about a horizontal axis of the journal 13 from the upright position of the frame member 16 to a horizontal position thereof; and (2) the forklift mechanism 22, 23 can be selectively displaced longitudinally of the pair of rails 14 in a fashion of a forklift mechanism.

Figure 10:
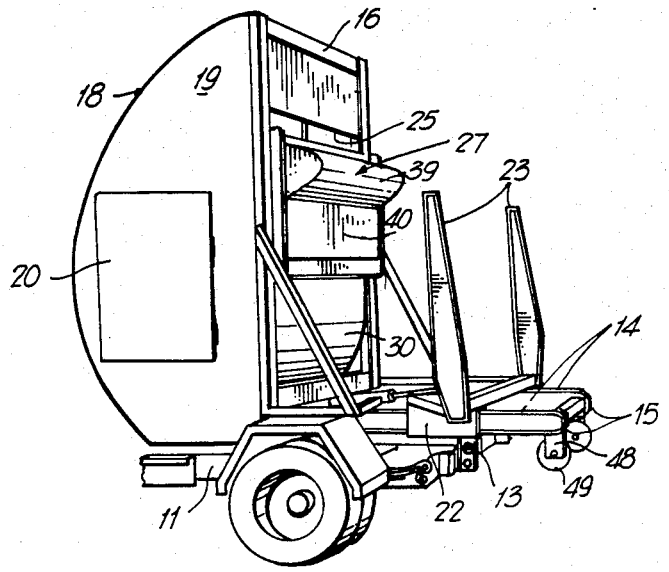
FIG. 10 is a broken-away perspective view of the rear end of a truck provided with the bulkhead of the invention but not showing the container for refuse storage.

Turning back to the arrangement of the chamber 18, the chamber is completely enclosed on sides and on top but is open at the rear end thereof, to provide a discharge opening 24 or passage which is of rectangular shape and extends generally the entire width of the chamber as best seen in FIG. 10. The upper limit 25 of the passage or opening 24 is slightly above a pivot axis 26 of a packer plate 27. The lower margin of the discharge passage 24 is generally coincident with an axis 28 of the bucket 29 whose curved bottom section 30 in effect closes the section of the rear end of the chamber 18 below the said discharge passage 24, as best seen in FIG. 10.

The arrangement of the elements described above, limiting the opening 24 is such that the effective size of the discharge opening 24 corresponds to an opening provided in the top of a standardized refuse container 31. Such containers are well known in the art and are usually provided (FIG. 2) with two lid members 32, 33 hinged along opposite edges of the top of the container. For instance, the lid 32 is hinged at 34 so that when the lid 32 is forced open (the hinge mechanism 34 is normally equipped with a resilient spring urging the lid 32 into closed position such as that of cover 33 in FIG. 2), an opening 35 is provided which corresponds approximately to one-half of the area of the top of the container. Each side of the container 31 is also provided with suitable lift pockets 36 for engagement by a forklift mechanism as is well known from the art of "top loading" refuse transporting vehicles.

Figure 9:
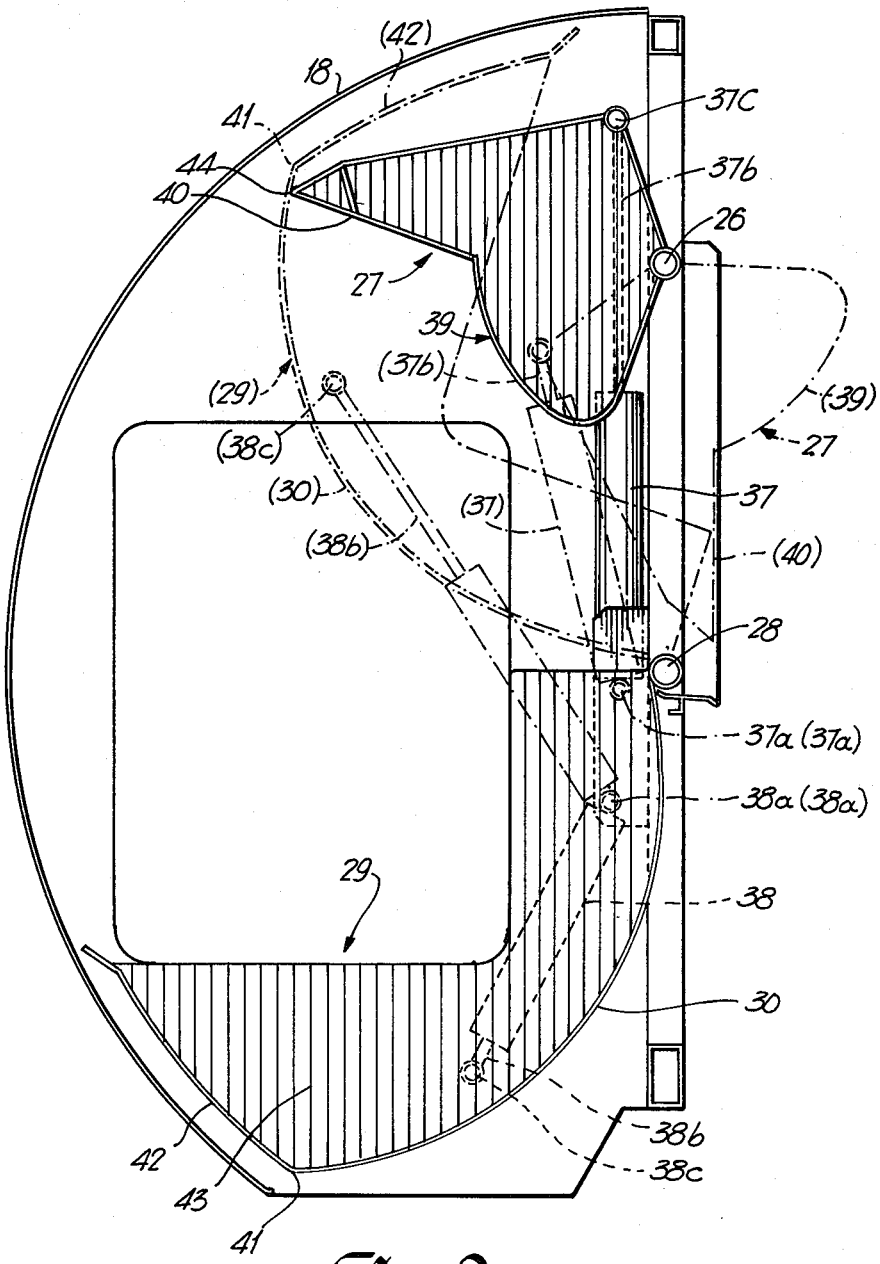
FIG. 9 is a simplified sectional view showing basic elements of the precompacting mechanism.

Turning back to FIG. 1, and comparing same with FIG. 9, it will be observed that the packer plate 27 can be pivoted, on actuation of a hydraulic cylinder 37 (controlled by one of elements 21) from the position shown in full lines of FIG. 9, wherein the packer plate 27 is generally horizontal and protrudes inwardly into the chamber to a position shown in broken lines of FIG. 9 or in FIG. 10, wherein the packer plate is generally vertical and flush with the discharge opening 24 thus forming a closure of same. The mechanism of the cylinder 37 is known in the art and is therefore shown only diagrammatically. As shown in FIG. 9, the cylinder 37 is pivotally secured to the framework of the bulkhead chamber 18 at 37*a*. The piston road 37*b* is pivotally secured to the packer plate 27 at 37*c*. With the piston rod 37*b* fully extended, the packer plate 27 is in its horizontal position. When the piston rod 37*b* is contracted, the packer plate is swung into a generally vertical position. A pair of hydraulic cylinders such as cylinder 38 (FIG. 9) is operatively associated with the bucket 29, for pivoting same from a lowered position shown in full lines to a raised position shown by broken lines in FIG. 9. The cylinder 38 is pivotally secured to the framework of the bulkhead chamber 18 for pivoting at 38*a*, with its piston rod 38*b* pivotally secured to the bucket 29 at 38*c*. On extension of the piston rod 38*b*, the bucket swings upwards as shown by dash-dotted lines of FIG. 9. The hydraulic cylinders 37 and 38 are shown only in a schematic way as the general arrangement of the mechanism is well known, for instance from the Brown et al. U.S. Pat. No. 2,798,624 and can be modified to a substantial degree without departing from the present invention.

In accordance with one of the features of the present invention, the surface of the packer plate 27 (FIG. 1) facing downwards to the bucket 29 is provided with a protrusion 39 extending the entire length or width of the packer plate and having a convexly shaped cross-sectional configuration which merges, proceeding towards the free end of the packer plate (to the right of FIG. 1) with a straight generally planar section 40. The sections 39 and 40 thus combine to form a cross-sectional configuration whose shape is best seen from FIGS. 1 and 6 through 9, wherein the packer plate is shown in cross section. It will be readily appreciated that the protrusion 39 with the packer plate in the position as shown in FIG. 1 forms, in effect, a protrusion member disposed at a close inward spacing of the discharge opening 24. The protrusion member extends along the top of the discharge opening 24 but protrudes below a normally horizontal level coincident with the top of the opening thus effectively reducing the clearance of the opening. It will also be appreciated, referring back to the Brown et al. patent and also to the Urban patent, that this arrangement is substantially different from what is shown in the aforesaid Brown et al. and Urban patents in that the cross-sectional clearance near the discharge opening is in fact restricted by the protrusion 39 when the packer plate 27 is in the position of FIG. 1.

As regards the bucket 29, it is of a shape generally corresponding to that described in the above prior art. In particular, the bucket 29 comprises a first bottom section 30 of a concavely curved cross-section and extending from the pivot axis 28 towards a tip portion 41, and a second bottom section 42, also of a concavely curved cross-section, extending from the tip 41 towards the free end of the bucket. At the sides, the bucket is provided with the usual upright side walls such as side wall 43. As is well known in the art, the radius of the cross-sectional curvature of bottom section 30 generally corresponds in size to the radius circumscribed by the free end tip portion 44 of the packer plate such that when the bucket 29 is raised, the tip edge 44 of the packer plate 27 is capable of moving along the section 30 thus sweeping the contents of the bucket through the discharge opening 24. The curvature of the second bottom section 42 of the bucket, on the other hand, is generally concentric with the pivot axis 28 of the bucket 29, to enable a "sweeping" relative motion between the tip 44 of the packer plate 27 and the bottom section 42 as the bucket 29 nears its uppermost position (during the motion from the position shown in FIG. 7 to that of FIG. 8). The relationship between the radii as discussed above is well known in the art, for instance from the first two prior art references mentioned at the outset of this specification.

The provision of the protrusion 39 on the packer plate 27 provides for a significant difference in operation of the device as will be apparent from the following description.

Figure 6:
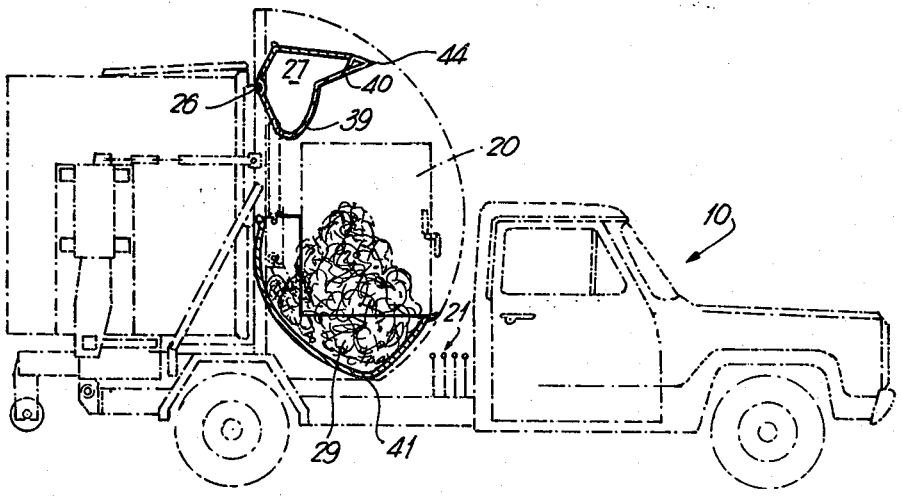
FIGS. 6–8 are diagrammatic sectional side views showing the sequence of the operation of the mechanism for precompacting and transfer of refuse from the bulkhead into the container.
Figure 7:
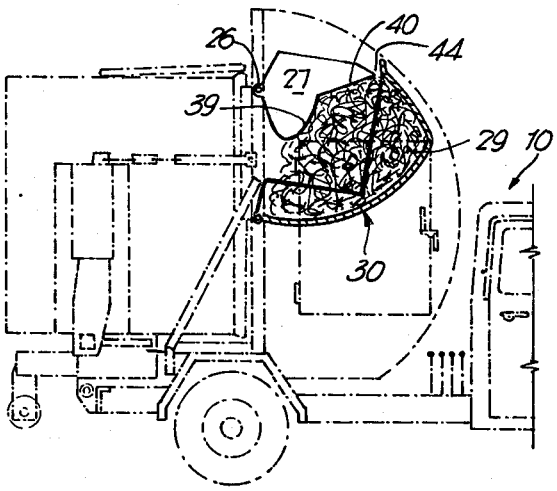
Figure 8:
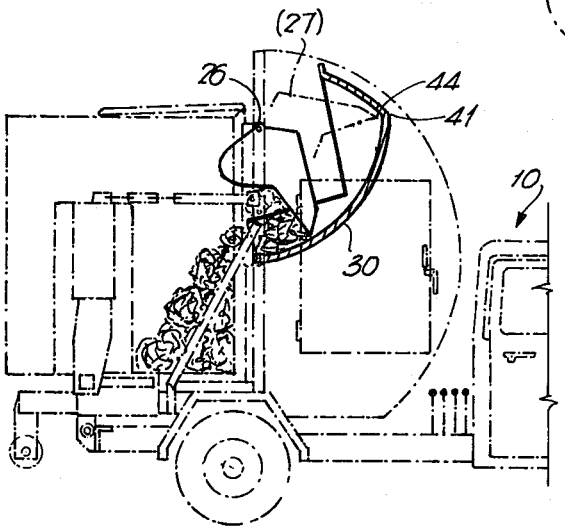

Turning firstly to FIG. 6, it will be observed that at this stage the bucket 29 is in its lowered position. A pile of refuse has been deposited during the garbage pickup, the loading having been effected manually, through the side openings normally closed by loading door 20. When a predetermined volume of garbage has been placed in the bucket 29, one of the control elements 21 is actuated thus causing counter-clockwise movement of the bucket 29 from the position shown in FIG. 6 to the position shown in FIG. 7. Meanwhile, the packer plate 27 is maintained in its generally horizontal position. As shown in FIG. 7, the surface of the refuse deposited within the bucket eventually contacts the packer plate 27. Due to the protrusion 39, a compacting effect will take place, at first, near the discharge opening. As the bucket continues to raise, the compacting continues and increases due to the decrease in the volume of the space limited by the planar portion 40 of the packer plate and the bottom section 30 which now faces the operative surface of the packer plate 27. Eventually, the bucket reaches its uppermost position (FIG. 8) at which the tip edge 44 of the packer plate 27 is generally coincident with the tip section 41 of the bucket. It will be appreciated on comparing FIGS. 6 and 8 (considering the broken line representation of the packer plate) that at this stage, the refuse contained in the bucket has already been considerably precompacted due to the reduced space between the packer plate and the bucket, and due to the fact that the protrusion 39 effectively prevented, by the first mentioned pre-compacting effect, a premature discharge of substantial part of the loaded refuse through the discharge opening 24. With the bucket 29 in its uppermost position as shown in FIG. 8, the packer plate 27 is now actuated for a clock-wise pivotal movement about its axis 26. The tip 44 of the packer plate now travels along the bottom section 30 cooperating with the protrusion in first still further increasing the compactness of the refuse and then forcing the refuse through the discharge opening 24 into the container 31.

Thus, the refuse discharged from the opening 24 is already precompacted to a substantial degree. This is of considerable advantage, since, on the one hand, the arrangement retains the relative simplicity of a combined pivotal bucket with a pivotal packer plate, without the need for an additional complex motion mechanism, while, at the same time, improving the effect of compacting of the refuse within the container due to the precompacted state of the material entering the container. As the container 31 becomes filled, the motion of the packer plate 27 near its position shown in FIG. 9, of course, further assists in compacting the refuse which had already been placed within the container.

Thus, the protrusion 39 on the packer plate 27 combines with the planar section 40 to provide effective precompacting of the refuse prior to its deposition within the refuse storage container. It will be appreciated, of course, that this mechanism can be applied to a great variety of different refuse transporting devices, regardless of the actual arrangement and type of the container within which the refuse is stored prior to its discharge from the vehicle. For instance, the precompacting aspect of the present invention is readily conceivable for use with a refuse body generally as described in the first two prior art references.

A further feature of the present invention which can be used with or without the feature of the elements active in the precompacting of refuse will now be described with particular reference to FIGS. 2 to 5 and also FIGS. 11 and 12.

Figure 11:
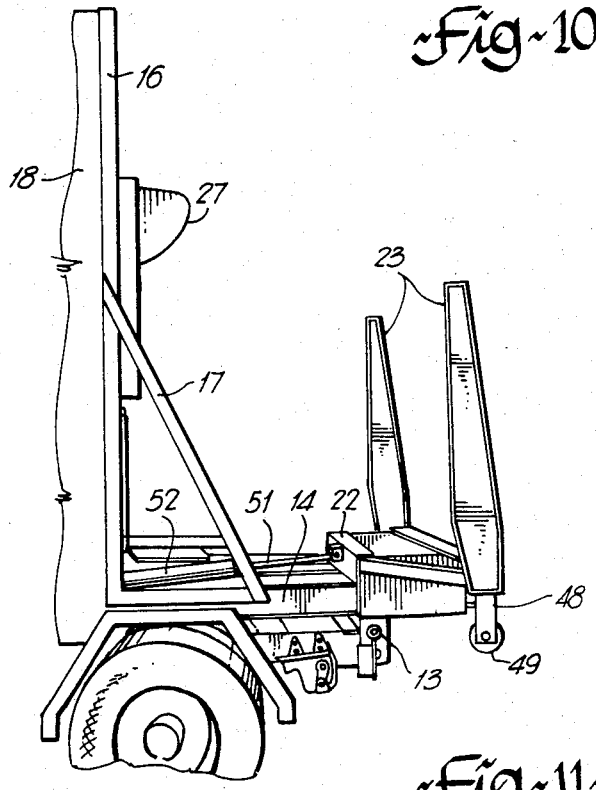
FIG. 11 is a perspective view similar to that of FIG. 10 but taken at a different angle.
Figure 12:
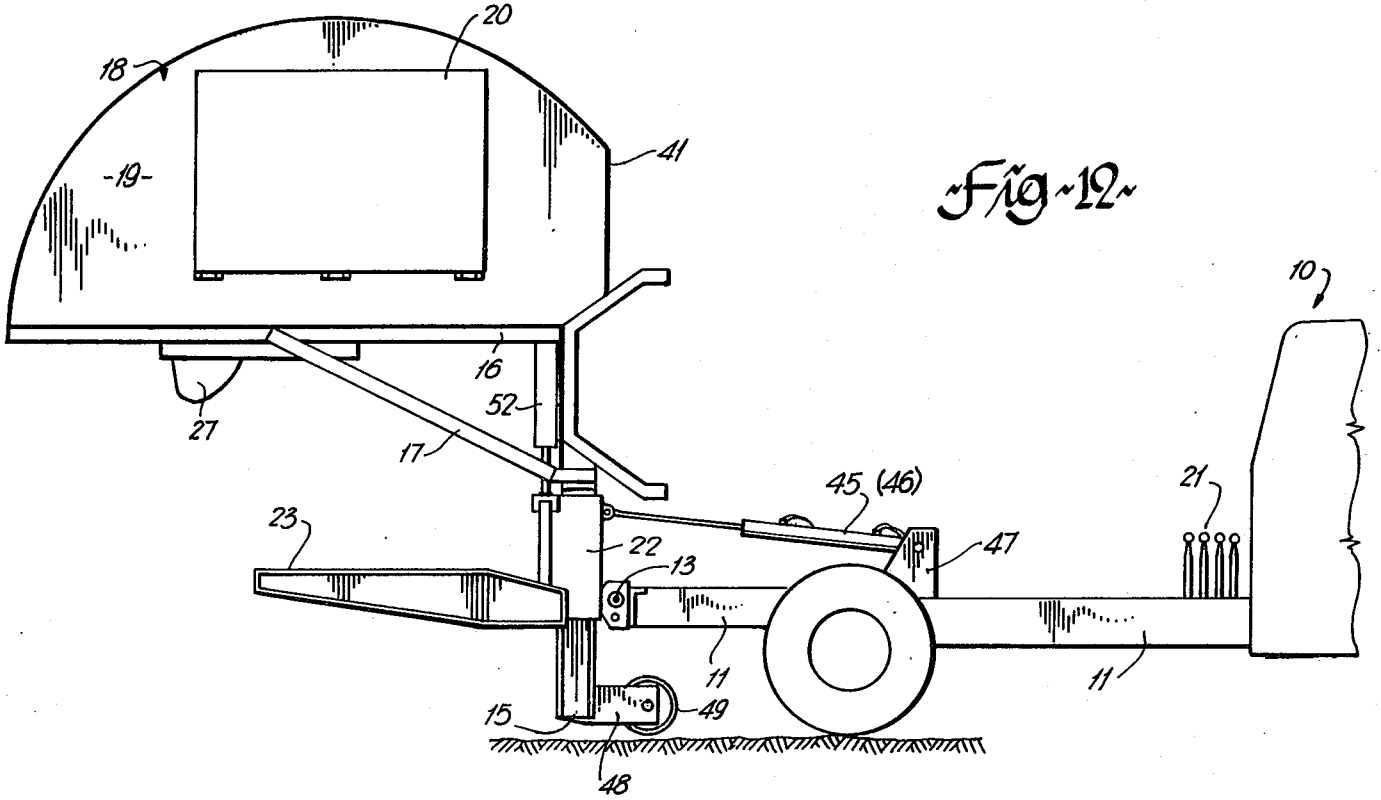
FIG. 12 is a simplified side view showing the device in a position ready to engage a refuse bin.

With particular reference, firstly, to FIG. 11, it will be observed that the slide 22 is mounted for sliding along the rails or sills 14 pivotal about the axis of journals 13 at the end of frame 11 of the truck. The actuation of pivotal movement is effected by a mechanism which is known per se, namely by a pair of hydraulic cylinders 45, 46 (FIG. 12) whose one end is pivotally secured to the frame 11 of the vehicle at brackets such as bracket 47.

The rear end of the frame 11 is provided, at each side of the frame, with a bracket 48 pivotally secured to the respective end of the sill 14. As the ends of the sills 14 at the joinders with the frame member 16 are raised, the rear ends of the sills and thus the brackets 48 swing downwards such that, eventually, the rollers 49 pivotally secured to the free end of bracket are very closely spaced above the ground, the position being shown in FIG. 12.

It is also apparent, particularly from FIG. 11, that the slide 22 is of a box-shaped structure operatively connected to the piston rod 51 of a hydraulic cylinder 52 which, in turn, is pivotally secured to the overall structure of the tipping sills 14 (the connection of the hydraulic cylinder 52 to the sills 14 not being shown) much in the forklift fashion. The actuation of the hydraulic cylinder 52 thus results in a displacement of the fork elements 23, as can be appreciated on comparing the position of the slide 22 in FIG. 10 and in FIG. 11.

Figure 2:
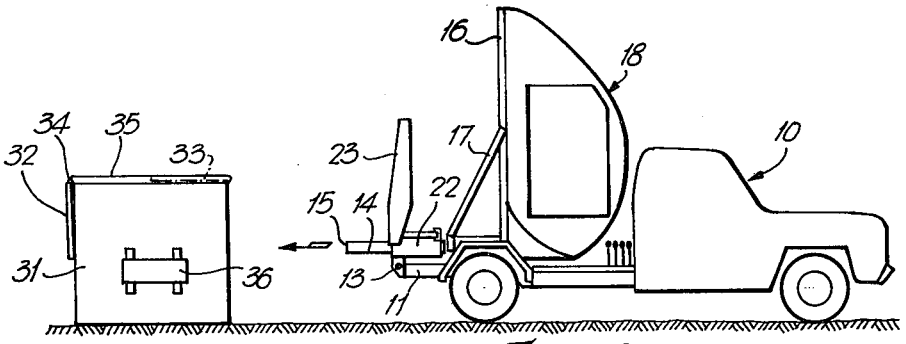
FIGS. 2–5 are diagrammatic side views similar to FIG. 1 and showing the sequence of attaching a refuse storage container to the device of the present invention.
Figure 3:
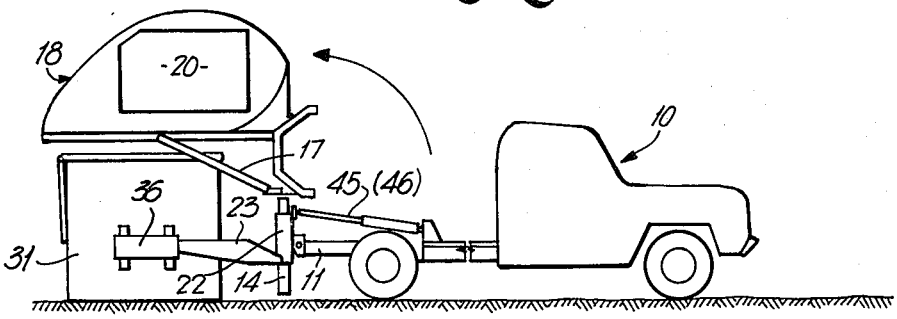
Figure 4:
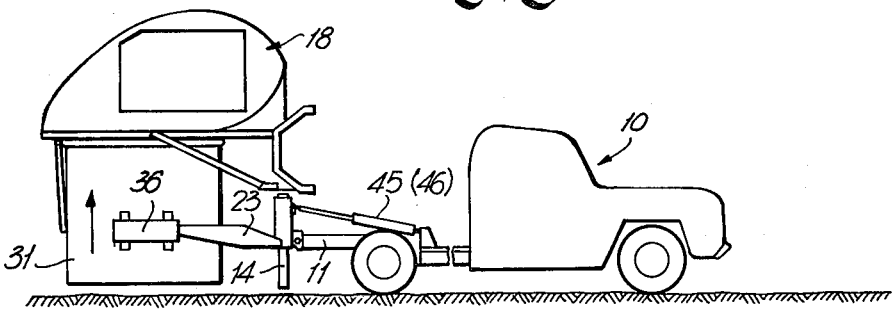
Figure 5:
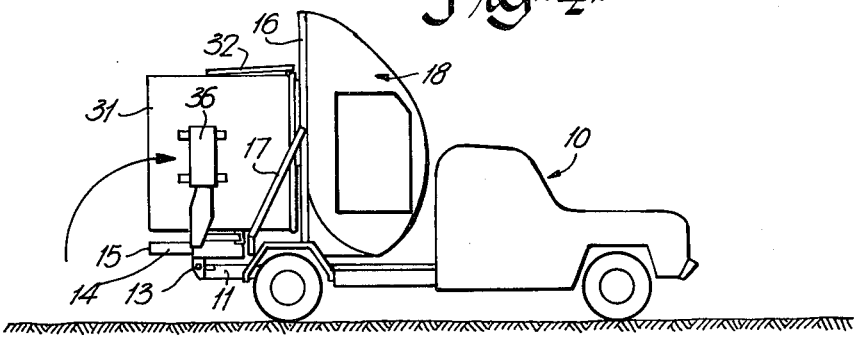

In use, the vehicle equipped with the bulkhead of the present invention is first to be provided with an empty bin or container 31. The truck 10 is backed towards the respective container 31 with the rear end or face of the chamber 18 in an upright position (FIG. 2). When the truck 10 is close to the bin 31, the hydraulic cylinders 45, 46 are actuated to tip the sills 14 and thus the chamber 18 over such that its normally rear end or face assumes a horizontal position and is disposed beyond the frame 11 of the vehicle. This position is also indicated in greater detail in FIG. 12. The brackets 48 (not shown in FIGS. 2–5) are now down and horizontal such that the wheel 49 of each bracket is close to or almost in engagement with the ground, to provide added support for the backing vehicle. The fork elements 23 are lowered or raised to the level required for engagement with the respective pockets 36 of the bin 31. The vehicle is then backed further until the forks 23 engage the pockets 36 of the bin, as shown in FIG. 3. On safe engagement of the forks 23 with the bin 31, the hydraulic cylinder 52 is actuated to raise the forks 23 and to thus abut the top of the bin 31 with the chamber 18 such that the top opening 35 (FIG. 2) generally coincides with the discharge opening 24 of the chamber 18. For all practical purposes, the state thus achieved (FIG. 4) results in the bin 31 forming a virtually integral part or extension of the chamber 18. The vehicle is now ready for a reverse actuation of hydraulic cylinders 45, 46 to return the chamber 18 and the now associated container 31 back to a position corresponding to that shown in FIG. 5 with the bin 31 now firmly attached to the chamber 18. The vehicle is now ready for servicing a particular route. The refuse is loaded through a loading opening accessible on the opening of the loading door 20. The filling of the bin 31 is effected by the mechanism within the chamber 18, either of the type of the present invention as described above, or of any other known type. When the container 31 is eventually filled and is to be replaced, the truck is backed to the container depot and the operational sequence reversed from the positions of FIG. 5, to FIG. 4, to FIG. 3, then the truck is driven forwards to release the forks 23 from the pockets 36 of the now loaded bin. The truck is now ready for attachment of another, empty container as described. Whether or not the chamber 18 is returned to the upright position of FIG. 2 between the bin replacement is at the operator's discretion. If the empty bin is only a short distance from the just released, filled container, the operator may decide to leave the chamber in its "tipped-over" position of FIG. 12. If the distance to the next container is more substantial or if the ground surface is uneven, it may be safer and more convenient to return the chamber to its state of FIG. 2, then to drive the truck to the next container and, eventually to proceed as described, with the operation sequence of FIGS. 2, 3, 4 and 5, as described.

The last described aspect of the present invention thus provides very simple refuse transporting device capable of being mounted on a regular truck chassis or frame without requiring a special type of the vehicle frame itself.

Those skilled in the art will appreciate that modifications of the present device may exist which depart to some degree from the aforesaid preferred embodiment. For instance, the forklift mechanism can be of a different type or an entirely different bin lifting mechanism can be employed even though the forklift is preferred. Various indicators or signals of compactness or weight of the refuse load can be used. The planar shape of the free end of the packer plate can be made concave. The described arrangement of the combined protrusion 39 and flat section 40 of the face of the packer plate is believed to be the best solution in this respect even though modifications thereof may exist. For instance, it is conceivable to arrange the packer plate for movement about a curved surface that would be disposed near the discharge opening 24 to substitute the protrusion 39, while the packer plate itself would be of the type of a flat rectangular blade circumscribing at its end remote from the pivot 26 the interior of the bucket, and, at its end relatively close to the pivot 26, would sweep the surface of such cylindric position. These examples are but few indications that it is possible to depart from the exact structure as described in the preferred embodiment, without departing from the present invention as defined in the accompanying claims.

The embodiments of the invention in which an exclusive property or privilege is claimed are defined as follows:

1. A refuse loading device for use with a vehicle for transporting refuse, said device comprising, in combination:

(a) a bulkhead chamber having a refuse loading opening and a refuse discharge opening spaced from the loading opening;

(b) refuse transfer means within said chamber for transfer of refuse from a region proximate to the loading opening to and through said discharge opening;

(c) mounting means for securing said chamber to a vehicle frame;

(d) chamber positioning means adapted to selectively change the position of the chamber relative to the respective vehicle frame from a first position wherein said discharge opening is disposed above the respective vehicle frame and is coincident with a generally vertical plane transverse of the respective vehicle frame to a second position wherein said discharge opening is disposed beyond the respective vehicle frame and is coincident with a generally horizontal plane spaced above the ground at a predetermined vertical spacing, said spacing being slightly in excess of the height of a standard refuse collecting container; and (e) refuse container attachment means associated with said mounting means for displacement in common therewith when said chamber positioning means is actuated, said container attachment means being of the type of a forklift mechanism complementary with a predetermined type of a refuse container, said forklift mechanism including fork means mounted on said mounting means for selectively actuated movement relative to said bulkhead chamber in a direction generally perpendicular to the plane coincident with said refuse discharge opening.

2. A device as claimed in claim 1, wherein said mounting means and said chamber positioning means includes a chamber supporting frame fixedly secured to said chamber and adapted for securement to the respective vehicle frame for pivotal movement of the supporting frame, and thus of the chamber, about a pivot axis transverse of the respective vehicle frame and disposed near the rear end thereof, said chamber positioning means further including selectively operable motor means for effecting said pivotal movement to thus displace the chamber from said first position to said second position and vice versa.

3. A device as claimed in claim 2, wherein said refuse container attachment means is arranged for attaching said refuse collecting container including a generally rectangular bottom, a pair of generally rectangular opposed side walls generally perpendicular to the bottom wall, and a pair of generally rectangular, opposed end walls generally perpendicular to the bottom wall and to the side walls, each wall of one of said pairs of walls being provided with a lift pocket disposed at the exterior of the respective wall, to the exterior of said chamber such that said discharge opening is generally flush with the top of the container.

4. A device as claimed in claim 2 or 3, wherein said pivot axis is coincident with a plane parallel with and spaced from the plane coincident with said discharge opening.

5. A refuse transporting vehicle including an elongated frame and a refuse loading device mounted on said frame, said device comprising, in combination:

(a) a bulkhead chamber having a refuse loading opening and a refuse discharge opening spaced from the loading opening;

(b) refuse transfer means within said chamber for transfer of refuse from a region proximate to the loading opening to and through said discharge opening;

(c) mounting means securing said chamber to said vehicle frame;

(d) chamber positioning means for selectively changing the position of said chamber relative to said vehicle frame from a first position wherein said discharge opening is disposed above said vehicle frame and is coincident with a generally vertical plane transverse in relation to said vehicle frame, to a second position wherein said discharge opening is disposed beyond said vehicle frame and is coincident with a generally horizontal plane spaced above the ground at a predetermined vertical spacing, said predetermined vertical spacing being slightly in excess of the height of a standard refuse collecting container; and (e) refuse container attachment means associated with said mounting means for displacement in common therewith when said chamber positioning means is actuated, said container attachment means being of the type of a forklift mechanism complementary with a predetermined type of a refuse container, said forklift mechanism including fork means mounted on said mounting means for selectively actuated movement relative to said bulkhead chamber in a direction generally perpendicular to the plane coincident with said refuse discharge opening.

6. A vehicle as claimed in claim 5, wherein said mounting means and said chamber positioning means includes a chamber supporting frame fixedly secured to said chamber and pivotally secured to said vehicle frame for pivotal movement of the supporting frame and thus of the chamber, about a pivot axis transverse of said vehicle frame and disposed near the rear end thereof, said chamber positioning means further including selectively operable motor means for effecting said pivotal movement to thus displace the chamber from said first position to said second position and vice versa.

7. A vehicle as claimed in claim 6, wherein said refuse container attachment means is arranged for attaching said refuse collecting container including a generally rectangular bottom, a pair of generally rectangular opposed side walls generally perpendicular to the bottom wall, and a pair of generally rectangular, opposed end walls, generally perpendicular to the bottom wall and to the side walls, each wall of one of said pairs of walls being provided with a lift pocket disposed at the exterior of the respective wall, to the exterior of said chamber such that said discharge opening is generally flush with the top of the container.

8. A vehicle as claimed in claim 6 or 7, wherein said pivot axis is generally coincident with the end of said vehicle frame and is also coincident with a plane parallel with but spaced from the plane coincident with said discharge opening.

9. A refuse loading device for use in vehicles said device including in combination:

(a) a bulkhead chamber having a refuse loading opening and a refuse discharge opening;

(b) bucket means disposed within said chamber and including a bucket mounted for pivotal movement about a transverse, normally generally horizontal first axis, from a lowered position, wherein the bucket is accessible from said loading opening, for loading refuse into the bucket, to a raised position, wherein the bucket is ready for discharge of its contents through said discharge opening;

(c) a packer plate within said chamber disposed for pivotal movement about a second axis generally parallel with said first axis and disposed normally generally parallel with said first axis and disposed normally generally vertically above same;

(d) said bucket and said packer plate being so arranged, disposed and shaped that, with the bucket raised, the packer plate can swing about said second axis to sweep refuse from the bucket through said discharge opening;

(e) said discharge opening being a generally rectangular passage in one end of said bulkhead chamber, including a generally horizontal top, a generally horizontal bottom and two opposed, normally vertical sides;

(f) said second axis being closely spaced from and generally parallel with said top and being generally coincident with one end of said packer plate, whereby said packer plate can swing from a first position wherein the plate protrudes inwardly into the chamber, to a second position wherein the plate is generally flush with said opening to close same;

(g) a protrusion member disposed at a close inward spacing of said discharge opening when the packer plate is in said first position, the protrusion member extending along said top of the discharge opening and protrudes below a normally horizontal level coincident with said top, to thus produce an obstruction limiting the clearance of the discharge opening interiorly of the chamber;

(h) securement means for operatively securing said bulkhead to a vehicle frame, said securement means including a chamber mounting frame having a first section fixedly secured to said chamber and a second section adapted to be secured to a vehicle frame for movably securing said chamber to the vehicle frame such that, on securement to the vehicle frame, the chamber is capable of being selectively displaced from a first position wherein said discharge opening is disposed above the vehicle frame and is generally coincident with an upright plane, to a second position wherein said discharge opening is disposed beyond the vehicle frame and coincident with a generally horizontal plane disposed at a predetermined vertical spacing above the ground, said predetermined spacing being slightly in excess of the height of a refuse collecting container including a generally rectangular bottom, a pair of generally rectangular opposed side walls generally perpendicular to the bottom wall, and a pair of generally rectangular opposed end walls generally perpendicular to the bottom wall and to the side walls, each wall of one of said pairs of walls being provided with a lift pocket disposed at the exterior of the respective wall, whereby, with the discharge opening in said second position, a vehicle carrying the device can be driven to the respective container to place said discharge opening above the top of the respective container;

(i) said securement means further comprising container attachment means for attaching to said chamber said container such that a portion of the top of the container becomes coincident with and generally snuggly attached to the exterior of the chamber around said discharge opening, for transfer of refuse from the chamber into the respective container;

(j) said container attachment means being a fork lift mechanism complimentary with said lift pockets and including fork means mounted on said second section of the frame of said securement means for movement in a direction generally perpendicular to the plane coincident with said discharge opening.

10. A refuse transporting vehicle having an elongated frame and including a refuse loading device mounted on the frame, said refuse loading device comprising, in combination:

(a) a bulkhead chamber; having a refuse loading opening and a refuse discharge opening;

(b) bucket means disposed within said chamber and including a bucket mounted for pivotal movement about a transverse, normally generally horizontal first axis, from a lowered position, wherein the bucket is accessible from said loading opening, for loading refuse into the bucket, to a raised position, wherein the bucket is ready for discharge of its contents through said discharge opening;

(c) a packer plate within said chamber disposed for pivotal movement about a second axis generally parallel with said first axis and disposed normally generally vertically above same;

(d) said bucket and said packer plate being so arranged, disposed and shaped that, with the bucket to sweep refuse from the bucket through said discharge opening;

(e) said discharge opening being a generally rectangular passage in one end of said bulkhead chamber, including a generally horizontal top, a generally horizontal bottom and two opposed, normally vertical sides;

(f) said second axis being closeley spaced from and generally parallel with said top and being generally coincident with one end of said packer plate, whereby said packer plate can swing from a first position wherein the plate protrudes inwardly into the chamber, to a second position wherein the plate is generally flush with said opening to close same;

(g) a protrusion member disposed at a close inward spacing of said discharge opening when the packer plate is in said first position, the protrusion member extending along said top of the discharge opening and protrudes below a normally horizontal level coincident with said top, to thus produce an obstruction limiting the clearance of the discharge opening interiorly of the chamber;

(h) securement means operatively securing said bulkhead to said vehicle frame, said securement means including a chamber mounting frame having a first section fixedly secured to said chamber and a second section secured to said vehicle frame movably securing said chamber to the vehicle frame such that, the chamber is capable of being selectively displaced from a first position wherein said discharge opening is disposed above the vehicle frame and is generally coincident with an upright plane, to a second position wherein said discharge opening is disposed beyond the vehicle frame and coincident with a generally horizontal plane disposed beyond the vehicle frame and coincident with a generally horizontal plane disposed at a predetermined vertical spacing above the ground;

(i) said predetermined spacing being slightly in excess of the height of a standard top loaded refuse collecting container, whereby, with the discharge opening in said second position, said vehicle can be driven to the respective container to place said discharge opening above the top of the respective container;

(j) said securement means further comprising container attachment means for attaching to said chamber said refuse collecting container including a generally rectangular bottom, a pair of generally rectangular opposed side walls generally perpendicular to the bottom wall, and a pair of generally rectangular opposed end walls generally perpendicular to the bottom wall and to the side walls, each wall of one said pairs of walls being provided with a lift pocket disposed at the exterior of the respective wall, such that a portion of the top of the container becomes coincident with a generally snugly attached to the exterior of the chamber around said discharge opening for transfer of refuse from the chamber into the container, the remaining part of the top of the container being provided with closure means resiliently held in place;

(k) said container attachment means being a fork lift mechanism complementary with said lift pockets and including fork means mounted on said second section of the frame of said securement means for movement in a direction generally perpendicular to the plane coincident with said discharge opening.

* * * * *